US011932825B2

(12) United States Patent
Jones et al.

(10) Patent No.: US 11,932,825 B2
(45) Date of Patent: Mar. 19, 2024

(54) LUBRICATING COMPOSITIONS AND METHODS OF OPERATING AN INTERNAL COMBUSTION ENGINE

(71) Applicant: The Lubrizol Corporation, Wickliffe, OH (US)

(72) Inventors: Craig J. Jones, Wessington (GB); Ben McDermott, Ashby de la Zouch (GB); Joanne L. Jones, Nottingham (GB); Ewan E. Delbridge, Victoria (AU); Alex Brewster, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 17/764,009

(22) PCT Filed: Sep. 24, 2020

(86) PCT No.: PCT/US2020/052494

§ 371 (c)(1),
(2) Date: Mar. 25, 2022

(87) PCT Pub. No.: WO2021/061986

PCT Pub. Date: Apr. 1, 2021

(65) Prior Publication Data

US 2022/0403284 A1 Dec. 22, 2022

Related U.S. Application Data

(60) Provisional application No. 62/906,130, filed on Sep. 26, 2019.

(51) Int. Cl.

| | |
|---|---|
| ***C10M 169/04*** | (2006.01) |
| ***C10M 141/06*** | (2006.01) |
| ***C10M 141/10*** | (2006.01) |
| ***C10N 20/04*** | (2006.01) |
| ***C10N 30/00*** | (2006.01) |
| ***C10N 30/04*** | (2006.01) |
| ***C10N 30/10*** | (2006.01) |
| ***C10N 40/25*** | (2006.01) |

(52) U.S. Cl.

CPC ..... *C10M 169/04* (2013.01); *C10M 141/06* (2013.01); *C10M 141/10* (2013.01); *C10M 2203/003* (2013.01); *C10M 2203/1025* (2013.01); *C10M 2205/0285* (2013.01); *C10M 2207/028* (2013.01); *C10M 2207/262* (2013.01); *C10M 2215/28* (2013.01); *C10M 2219/046* (2013.01); *C10M 2219/068* (2013.01); *C10M 2223/045* (2013.01); *C10M 2229/00* (2013.01); *C10N 2020/04* (2013.01); *C10N 2030/04* (2013.01); *C10N 2030/10* (2013.01); *C10N 2030/52* (2020.05); *C10N 2030/54* (2020.05); *C10N 2040/255* (2020.05)

(58) Field of Classification Search

CPC ..... C10M 141/06; C10M 141/10; C10M 169/04; C10M 2203/003; C10M2203/1025; C10M 2205/0285; C10M 2207/028; C10M 2207/262; C10M 2215/28; C10M 2219/068; C10M 2223/045; C10M 2229/00; C10N 2020/04; C10N 2030/04; C10N 2030/10; C10N 2030/52; C10N 2030/54; C10N 2040/255; C10N 2010/04; C10N 2060/14; C10N 2010/12

See application file for complete search history.

(56) References Cited

U.S. PATENT DOCUMENTS

| | | | | |
|---|---|---|---|---|
| 4,285,822 | A | 8/1981 | Devries et al. | |
| 4,863,623 | A | 9/1989 | Nalesnik | |
| 5,490,945 | A | 2/1996 | Smith et al. | |
| 6,107,257 | A | 8/2000 | Valcho et al. | |
| 6,107,258 | A | 8/2000 | Esche, Jr. et al. | |
| 6,117,825 | A | 9/2000 | Liu et al. | |
| 6,153,565 | A | 11/2000 | Skinner et al. | |
| 6,165,235 | A | 12/2000 | Kolp et al. | |
| 6,232,276 | B1 | 5/2001 | Stiefel et al. | |
| 6,281,179 | B1 | 8/2001 | Skinner et al. | |
| 6,329,327 | B1 | 12/2001 | Tanaka et al. | |
| 6,429,178 | B1 | 8/2002 | Skinner et al. | |
| 6,429,179 | B1 | 8/2002 | Skinner et al. | |
| 6,914,037 | B2 | 7/2005 | Gatto | |
| 7,285,516 | B2 | 10/2007 | Carrick et al. | |
| 7,615,519 | B2 | 11/2009 | Esche, Jr. et al. | |
| 7,615,521 | B2 * | 11/2009 | Eveland | C10M 129/42 508/228 |
| 7,696,136 | B2 | 4/2010 | Migdal et al. | |
| 7,727,943 | B2 | 6/2010 | Brown et al. | |
| 7,790,661 | B2 | 9/2010 | Covitch et al. | |
| 7,838,474 | B2 | 11/2010 | Boffa | |
| 9,885,004 | B2 | 2/2018 | Deckman et al. | |
| 10,519,394 | B2 | 12/2019 | Dance et al. | |
| 10,781,395 | B2 | 9/2020 | Tamura | |
| 2005/0038319 | A1 | 2/2005 | Goldwasser et al. | |
| 2010/0197536 | A1 | 8/2010 | Mosier et al. | |
| 2017/0096617 | A1 * | 4/2017 | Clarke | C10M 161/00 |
| 2018/0066203 | A1 * | 3/2018 | Dance | C10M 169/04 |

(Continued)

FOREIGN PATENT DOCUMENTS

| | | | |
|---|---|---|---|
| CA | 1183125 | 2/1985 | |
| EP | 2001983 | 2/2015 | |
| WO | 20060015130 | 2/2006 | |
| WO | 20060044411 | 4/2006 | |
| WO | 20060047486 | 5/2006 | |
| WO | 20080147704 | 12/2008 | |
| WO | 20160154167 A1 | 9/2016 | |
| WO | 20180156304 | 8/2018 | |
| WO | WO-2019092492 A1 * | 5/2019 | C10M 129/54 |

*Primary Examiner* — James C Goloboy

(74) *Attorney, Agent, or Firm* — Eryn A. Fuhrer; Michael A. Miller

(57) ABSTRACT

The instant disclosure generally relates to lubricating compositions having an oil of lubricating viscosity, a mixture of boron-containing and boron-free dispersants, an overbased magnesium-based detergent, an overbased calcium-based detergent, a molybdenum-containing material, and, optionally, other performance additives. The instant lubricating compositions may improve one or more of cleanliness, TBN retention, fuel economy and low-speed preignition ("LSPI").

24 Claims, No Drawings

(56) References Cited

U.S. PATENT DOCUMENTS

| | | | |
|---|---|---|---|
| 2018/0237722 | A1 | 8/2018 | Burns, III et al. |
| 2019/0024015 | A1 | 1/2019 | Blumenfeld et al. |
| 2021/0189284 | A1* | 6/2021 | Shimodate ..... C10M 141/12 |

* cited by examiner

LUBRICATING COMPOSITIONS AND METHODS OF OPERATING AN INTERNAL COMBUSTION ENGINE

CROSS REFERENCE TO RELATED APPLICATION

This application claims priority from PCT Application Serial No. PCT/US2020/052494 filed on Sep. 24, 2020, which claims the benefit of U.S. Provisional Application No. 62/906,130 filed on Sep. 26, 2019, both of which are incorporated in their entirety by reference herein.

FIELD

The instant disclosure generally relates to lubricating compositions having an oil of lubricating viscosity, a mixture of boron-containing and boron-free dispersants, an overbased magnesium-based detergent, an overbased calcium-based detergent, a molybdenum-containing material, and, optionally, other performance additives. The instant lubricating compositions may improve one or more of cleanliness, TBN retention, fuel economy and low-speed preignition ("LSPI").

BACKGROUND

Modern engines are designed to provide ever-improving fuel economy without sacrificing cleanliness or durability. Current and proposed specifications for crankcase lubricants, such as API SN plus and ILSAC GF-6 for passenger car motor oils, and API CK-4 for heavy duty diesel engines specify increasingly stringent standards to meet government requirements for efficiency. Previous lubricating formulations may not perform as acceptable levels when addressing issues like cleanliness, fuel economy, TBN retention, and/or low-speed preignition. Thus, there is need for improved mid-saps lubricating formulations that demonstrate one or more of improved cleanliness, fuel economy, TBN retention, and low-speed preignition.

SUMMARY

The instant disclosure related to gasoline-fueled internal combustion engine lubricating compositions. The compositions include an oil of lubricating viscosity comprising at least 50 wt % of a Group III base oil; a boron-containing polyisobutenyl succinimide dispersant; a boron-free polyisobutenyl succinimide dispersant; an overbased magnesium-based detergent in an amount to deliver at least 400 ppm magnesium to the lubricating composition; an overbased calcium-based detergent in an amount to deliver at least 400 ppm calcium to the lubricating composition; and a molybdenum-containing material.

In another embodiment, the composition of the instant disclosure may include an oil of lubricating viscosity comprising at least 50 wt % of a Group III base oil; a boron-containing polyisobutenyl succinimide dispersant having a number average molecular weight of from 1750 to 2200; a boron-free polyisobutenyl succinimide dispersant having a number average molecular weight of from 750 to 2500; an overbased magnesium-based detergent in an amount to deliver at least 400 ppm magnesium to the lubricating composition; an overbased calcium-based detergent in an amount to deliver at least 400 ppm calcium to the lubricating composition; and a molybdenum-containing material selected from a molybdenum dithiocarbamate complex, a molybdenum dithiocarbamate, and a tri-nuclear molybdenum compound and in an amount to provide 50 to 500 ppm molybdenum to the lubricating composition.

In another embodiment, the composition of the instant disclosure may include an oil of lubricating viscosity comprising at least 50 wt % of a Group III base oil; 1 to 2.1 wt % of a boron-containing polyisobutenyl succinimide dispersant having a number average molecular weight of from 1750 to 2200; 1.5 to 4.1 wt % of a boron-free polyisobutenyl succinimide dispersant having a number average molecular weight of from 750 to 2500; an overbased magnesium-based detergent in an amount to deliver at least 400 ppm magnesium to the lubricating composition; an overbased calcium-based detergent in an amount to deliver at least 400 ppm calcium to the lubricating composition; and a molybdenum-containing material selected from a molybdenum dithiocarbamate complex, a molybdenum dithiocarbamate, and a tri-nuclear molybdenum compound and in an amount to provide 40 to 1200 ppm molybdenum to the lubricating composition.

In one embodiment, the composition of the instant disclosure may include an oil of lubricating viscosity comprising at least 50 wt % of a Group III base oil; a boron-containing polyisobutenyl succinimide dispersant having a number average molecular weight of from 1750 to 2200; a boron-free polyisobutenyl succinimide dispersant having a number average molecular weight of from 750 to 2500; an overbased magnesium-based detergent in an amount to deliver from 400 to 700 ppm magnesium to the lubricating composition; an overbased calcium-based detergent in an amount to deliver at least 400 ppm calcium to the lubricating composition; and a molybdenum-containing material selected from a molybdenum dithiocarbamate complex, a molybdenum dithiocarbamate, and a tri-nuclear molybdenum compound and in an amount to provide 40 to 1200 ppm molybdenum to the lubricating composition.

In one embodiment, the composition of the instant disclosure may include an oil of lubricating viscosity comprising at least 50 wt % of a Group III base oil; a boron-containing polyisobutenyl succinimide dispersant having a number average molecular weight of from 1750 to 2200; a boron-free polyisobutenyl succinimide dispersant having a number average molecular weight of from 750 to 2500; an overbased magnesium-based detergent in an amount to deliver from 400 to 700 ppm magnesium to the lubricating composition; a mixture of overbased calcium-based detergents including 0.2 to 0.5 wt % of an overbased calcium salixerate detergent and 0.3 to 0.7 wt % of an overbased calcium salicylate detergent, wherein the mixture of calcium detergent delivers from 400 ppm to 1200 ppm calcium to the lubricating composition; and a molybdenum-containing material selected from a molybdenum dithiocarbamate complex, a molybdenum dithiocarbamate, and a tri-nuclear molybdenum compound and in an amount to provide 40 to 1200 ppm molybdenum to the lubricating composition.

In another aspect of the disclosure relates to methods of reducing low speed preignition in a gasoline-fueled internal combustion engine operating at a brake mean effective pressure (BMEP) of greater than 12 bars and at a speed of less than 3,00 RPM's by supplying to said engine any one of the lubricating compositions disclosed herein.

The instant disclosure further relates to methods of improving TBN retention of a lubricating composition in a gasoline-fueled internal combustion engine by supplying to said engine any one of the lubricating compositions disclosed herein.

The instant disclosure also related to use of any one of the lubricating compositions disclosed herein to improve one or more of cleanliness, TBN retention, and fuel economy in a gasoline-fueled internal combustion engine.

DETAILED DESCRIPTION

The instant disclosure relates to lubricating compositions for a gasoline-fueled internal combustion engine. The lubricating compositions include an oil of lubricating viscosity where at least 50 wt % of the oil is a Group III base oil; a boron-containing polyisobutenyl susccinimide dispersant; a boron-free polyisobutenyl succinimide dispersant; an overbased magnesium-based detergent in an amount to deliver at least 400 ppm magnesium to the lubricating composition; an overbased calcium-based detergent in an amount to deliver at least 400 ppm calcium to the lubricating composition; an ashless friction modifier; and, optionally, other performance additives as described herein.

Oils of Lubricating Viscosity

As used herein, an oil of lubricating viscosity may include natural and synthetic base oils, oil derived from hydrocracking, hydrogenation, and hydrofinishing, unrefined, refined, re-refined base oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). The cited portions of both references are incorporated herein. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Suitable oils may be produced from biological, i.e. natural, sources or by bio-engineered processes. This includes both natural occurring oils, such as vegetable oils and triglyceride oils that may be further refined or purified by standard processes, and those oils that may be derived by biological conversion of a natural chemical into oil directly or by bio-formation of building block pre-cursor molecules capable of being further converted into oil by known processes.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10), which are incorporated herein by reference.

Group IV base oils (also known as polyalphaolefins or PAO) are known in the art and are prepared by oligomerization or polymerization of linear alpha olefins. PAOs are characteristically water white oils with superior low temperature viscosity properties (as measured, as well as high viscosity index. Typical PAOs suitable for use in internal combustion engines include PAO-4 and PAO-6, i.e. approximately 4 $m^2/s$ and 6 $m^2/s$ respectively.

In one embodiment the oil of lubricating viscosity may be a base oil including API Group I to IV oil, an ester or a synthetic oil, or mixtures thereof. In one embodiment the oil of lubricating viscosity may be an API Group II, Group III, Group IV oil, an ester or a synthetic oil, or mixtures thereof. In some embodiments, the oil of lubricating viscosity comprises at least 50 wt %, or at least 60 wt %, or at least 70 wt %, or at least 80 wt %, or at least 90 wt %, or at least 95 wt %, or at least 100 wt % of a Group III or a Group IV base oil.

The amount of the oil of lubricating viscosity present is typically the balance remaining after subtracting from 100 wt % the sum of the amount of the additives present in the lubricating composition.

The lubricating composition may be in the form of a concentrate and/or a fully formulated lubricant. If the lubricating composition of the instant disclosure is in the form of a concentrate, which may be combined with additional oil to form, in whole or in part, a finished lubricant, the ratio of these additives to the oil of lubricating viscosity and/or to diluent oil include the ranges of 1:99 to 99:1 by weight, or 80:20 to 10:90 by weight. Typically, the lubricating composition of the invention comprises at least 50 wt %, or at least 60 wt %, or at least 70 wt %, or at least 80 wt % of an oil of lubricating viscosity.

In the present disclosure, the lubricating composition can include a base oil having a kinematic viscosity measured at 100° C. of 2.4 $m^2/s$ to 6.4 $m^2/s$. In some embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In other embodiments, the kinematic viscosity is 6.2 $m^2/s$ or 5.6 $m^2/s$ or 4.6 $m^2/s$.

Polyisobutenyl Succinimide Dispersant(s):

The lubricating composition of the instant disclosure further includes a boron-containing polyisobutenyl succinimide dispersant and a boron-free polyisobutenyl succinimide dispersant. The reference herein to a polyisobutylene-based dispersant refers to both the boron-containing polyisobutenyl succinimide dispersant as well as the boron-free polyisobutenyl succinimide dispersant. The difference being that that boron-containing polyisobutenyl succinimide dispersant is post-treated with a boron compound, as described herein.

The boron-containing polyisobutenyl succinimide and/or the boron-free polyisobutenyl succinimide dispersants can each be prepared from a polyisobutylene ("PIB") succinimide dispersant that is either a "conventional" PIB or a high vinylidene PIB. The difference between a conventional polyolefin and a high vinylidene polyolefin can be illustrated by reference to the production of PIB. In a process for producing conventional PIB, isobutylene is polymerized in the presence of AlCl3 to produce a mixture of polymers comprising predominantly trisubstituted olefin (III) and tetrasubstituted olefin (IV) end groups, with only a very small amount (for instance, less than 20 percent) of chains containing a terminal vinylidene group (I). In an alternative process, isobutylene is polymerized in the presence of BF3 catalyst to produce a mixture of polymers comprising predominantly (for instance, at least 70 percent) terminal vinylidene groups, with smaller amounts of tetrasubstituted end groups and other structures. The materials produced in the alternative method, sometimes referred to as "high vinylidene PIB," are also described in U.S. Pat. No. 6,165,235, which is incorporated herein by reference in its entirety. In one embodiment, the polyisobutylene-based dispersant is a conventional polyisobutylene-based dispersant. In another embodiment, the polyisobutylene-based dispersant is a high or mid vinylidene succinimide dispersant. The polyisobutylene-based dispersant used herein is generally known in the art.

The polyisobutylene-based acylating agent may be prepared/obtained/obtainable from reaction with maleic anhydride by an "ene" or "thermal" reaction. The "ene" reaction mechanism and general reaction conditions are summarized in "Maleic Anhydride", pages, 147-149, Edited by B. C. Trivedi and B. C. Culbertson and Published by Plenum Press in 1982. The polyisobutylene-based dispersant prepared by a process that includes an "ene" reaction includes a dispersant having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The polyisobutylene-based acylating agent may also be obtained/obtainable from a chlorine-assisted process, often involving Diels-Alder chemistry, leading to formation of carbocyclic linkages. The process is known to a person skilled in the art. The chlorine-assisted process may produce an acylating agent having a carbocyclic ring present on 50 mol % or more, or 60 to 100 mol % of the molecules. Both the thermal and chlorine-assisted processes are described in greater detail in U.S. Pat. No. 7,615,521, columns 4-5 and preparative examples A and B.

The polyisobutylene-based acylating agent may also be prepared/obtained/obtainable from a free radical process, wherein the acylating agent is reacted with polyisobutylene in the presence of a free radical initiator. Free radical processes of this sort are well known in the art and may be carried out in the presence of an additional alpha-olefin.

The polyisobutylene-based acylating agent can be obtained from reacting polyisobutylene with an acylating agent, i.e. an ethylenically unsaturated carbonyl compound, to form an acylated polyisobutylene which may be further functionalized with an amine or alcohol to form a suitable dispersant. Suitable acylating agents include maleic anhydride or a reactive equivalent thereof (such as an acid or ester), i.e., succinic acid, and their reactive equivalents. In one embodiment, polyisobutylene may be reacted with maleic anhydride to form acylated product with a conversion between 1 and 2. In one embodiment, the monosuccan is reacted with an amine so that the intended product comprises a mixture wherein all of the anhydride present in the acylating agent has been converted to imide.

The polyisobutylene-based dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The polyisobutylene-based dispersant as described herein can further be described as having a TBN. In one embodiment, the polyisobutylene-based dispersant has a TBN of from 5 to 50. In another embodiment, the polyisobutylene-based dispersant has a TBN of from 10 to 40. In yet another embodiment, the polyisobutylene-based dispersant has a TBN of from 15 to 30.

The lubricating composition of the instant disclosure includes a polyisobutylene-based dispersant that is a boron-free polyisobutylene succinimide dispersant as described herein. The boron-free polyisobutylene succinimide dispersant may be present in the lubricating composition in an amount ranging from 0.5 wt % to 6.5 wt %. In some embodiments, the boron-free polyisobutylene succinimide dispersant is present in an amount ranging from 0.7 to 6.5 wt %, or 1.5 to 4.1 wt %, or 2.0 to 3.1 wt %, or 2.5 to 2.8 wt %.

In one embodiment, the boron-free polyisobutylene succinimide dispersant has a number average molecular weight ranging from 750 to 2500. In some embodiments, the boron-free polyisobutylene succinimide dispersant has a number average molecular weight ranging from 750 to 1750, or 900 to 1450, or 1050 to 1250, or 1400 to 1600. In other embodiments, the boron-free polyisobutylene succinimide dispersant number average molecular weight can range from 1950 to 2500, or 2100 to 2400, or 2200 to 2350.

In one embodiment, the boron-free polyisobutylene succinimide dispersant includes a first boron-free polyisobutylene succinimide dispersant having a number average molecular weight ranging from 750 to 1750 and a second boron-free polyisobutylene succinimide dispersant having a number average molecular weight ranging from 1950 to 2500. In another embodiment, the first boron-free polyisobutylene succinimide dispersant has a number average molecular weight ranging from 1150 to 1650 and a second boron-free polyisobutylene succinimide dispersant having a number average molecular weight ranging from 2100 to 2450. In one embodiment, the first boron-free polyisobutylene succinimide dispersant is present in the lubricating composition in an amount ranging from 0.5 to 4.5 wt. % and the second boron-free polyisobutylene succinimide dispersant is present in the lubricating composition in an amount ranging from 0.2 to 2.0 wt. %. In another embodiment, the first boron-free polyisobutylene succinimide dispersant is present in the lubricating composition in an amount ranging from 1.8 to 2.5 wt % and the second boron-free polyisobutylene succinimide dispersant is present in the lubricating composition in an amount ranging from 0.5 to 0.8 wt %. In one embodiment, the first boron-free polyisobutylene succinimide dispersant has a number average molecular weight ranging from 750 to 1750 and is present in the lubricating composition in an amount ranging from 0.5 to 4.5 wt. % and the second boron-free polyisobutylene succinimide dispersant has a number average molecular weight ranging from 1950 to 2500 and is present in the lubricating composition in an amount ranging from 0.2 to 2.0 wt. %. In one embodiment, the first boron-free polyisobutylene succinimide dispersant comprises 60% to 90%, or 65% to 85%, or 70% to 80%, or 75% to 80% of the total combination of the first boron-free polyisobutylene succinimide dispersant and the second boron-free polyisobutylene succinimide dispersant.

Polyisobutylene succinimide dispersants of the invention may be prepared by reaction of the acylated PIB with a suitable amine compound. Suitable amines include one or more hydrocarbylamines, aminoalcohols, polyetheramines, or combinations thereof.

In one embodiment, the hydrocarbyl amine component may comprise at least one aliphatic amine containing at least one amino group capable of condensing with said acyl group to provide a pendant group and at least one additional group comprising at least one nitrogen, oxygen, or sulfur atom. Suitable aliphatic amines include polyethylene polyamines (such as tetraethylene pentamine (TEPA), triethylene tetra amine (TETA), pentaethylene hexamine (PEHA), and polyamine bottoms), N,N-dimethylaminopropylamine (DMAPA), N-(aminopropyl)morpholine, N,N-dilsostearylaminopropylamine, ethanolamine, and combinations thereof.

In one embodiment, the hydrocarbyl amine component may comprise at least one aromatic amine containing at least one amino group capable of condensing with said acyl group to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a C(O)NR— group, a —C(O)O— group, an —O— group, an N═N— group, or an —SO2- group where R is hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N,N-phenyldiamine), and (vii) a ring-substituted benzylamine.

In one embodiment, the polyetheramine compound may comprise an amine-terminated polyether compound. Amine terminated polyether compounds may comprise units derived from ethylene oxides, propylene oxides, butylene oxides, or some combination thereof. Suitable polyether compounds include Jeffamine® line of polyether amines available from Huntsman.

The lubricating composition of the instant disclosure further includes a boron-containing polyisobutylene succinimide dispersant. In preparing the boron-containing polyisobutylene succinimide dispersant, the polyisobutylene-based dispersant as described herein may be post-treated by conventional methods including a reaction with boron compounds to generate the boron-containing polyisobutylene succinimide dispersant. Suitable boron compounds that may be used to borate the polyisobutylene-based dispersant include one or more of a variety of agents selected from the group consisting of the various forms of boric acid (including metaboric acid, HBO2, orthoboric acid, H3BO3, and tetraboric acid, H2B4O7), boric oxide, boron trioxide, and alkyl borates. In one embodiment the borating agent is boric acid which may be used alone or in combination with other borating agents. Methods of preparing borated dispersants are known in the art. The borated dispersant may be prepared in such a way that they contain 0.1 weight % to 2.5 weight % boron, or 0.1 weight % to 2.0 weight % boron or 0.2 to 1.5 weight % boron or 0.3 to 1.0 weight % boron.

In one embodiment, the boron-containing polyisobutylene succinimide dispersant is derived from a polyisobutylene having a vinylidene content of greater than 70 mol %, or greater than 80 mole %, or greater than 85 mol %, or greater than 90 mol %.

In one embodiment, the boron-containing polyisobutylene succinimide dispersant has a number average molecular weight ranging from 1750 to 2200, or 1850 to 2150, or 1950 to 2250. The boron-containing polyisobutylene succinimide dispersant can be present in the lubricating composition in an amount ranging from 0.2 to 2.1 wt %, or 0.5 to 1.8 wt %, or 1 to 2.1 wt %, or 1.5 to 1.7 wt %. In some embodiments, the boron-containing polyisobutylene succinimide dispersant is present in an amount to deliver at least 75 ppm boron to the lubricating composition. In another embodiment, the boron-containing polyisobutylene succinimide dispersant is present in an amount to deliver at least 100 ppm boron to the lubricating composition. In one embodiment, the boron-containing polyisobutylene succinimide dispersant is present in an amount to deliver at least 125 ppm boron to the lubricating composition. In some embodiments, the boron-containing polyisobutylene succinimide dispersant is present in an amount to deliver at least 150 ppm boron to the lubricating composition. In one embodiment, the boron-containing polyisobutylene succinimide dispersant is present in an amount to deliver at least 165 ppm boron to the lubricating composition. In one embodiment, the boron-containing polyisobutylene succinimide dispersant is present in an amount to deliver at least 200 ppm boron to the lubricating composition. In one embodiment, the boron-containing polyisobutylene succinimide dispersant is present in an amount to deliver from 125 to 200 ppm boron to the lubricating composition.

Metal Overbased Detergents:

The instant lubricating composition includes an overbased magnesium-based detergent and an overbased calcium-based detergent.

Metal overbased detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may include one or more of non-sulfur containing phenates, sulfur containing phenates, sulfonates, salicylates, and mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased detergent of the invention may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 600 TBN. Overbased sulfonates typically have a total base number of 250 to 600, or 500 to 850. Overbased detergents are known in the art.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) tetrapropenylphenol, i.e., p-dodecylphenol or PDDP. In one embodiment, the lubricating composition of the invention contains less than 0.3 weight percent of alkylphenol, less than 0.1 weight percent of alkylphenol, or less than 0.05 weight percent of alkylphenol.

The overbased magnesium-based detergent includes magnesium salts, or mixtures thereof of the phenates, sulfur-containing phenates, sulfonates, salixarates and salicylates. In one embodiment, the overbased magnesium-based detergent is an overbased alkylbenzene sulfonate having a metal ratio of at least 8. In one embodiment, the overbased magnesium-based detergent is present in the lubricating composition to deliver at least 400 ppm of magnesium to the lubricating composition. In one embodiment, the overbased magnesium-based detergent is present in the lubricating composition to deliver at least 500 ppm of magnesium to the lubricating composition. In another embodiment, the overbased magnesium-based detergent is present in the lubricating composition to deliver at least 600 ppm of magnesium to the lubricating composition. In another embodiment, the overbased magnesium-based detergent is present in the lubricating composition to deliver from 400 to 1200 ppm of magnesium to the lubricating composition. In another embodiment, the overbased magnesium-based detergent is present in the lubricating composition to deliver from 400 to 1200 700 of magnesium to the lubricating composition.

The overbased magnesium-based detergent can be present in the lubricating composition in an amount of from 0.1 to 1.5 wt %, or 0.2 to 0.8 wt % or 0.2 to 0.4 wt %. In some embodiments, the overbased magnesium-based detergent has a total base number ("TBN") greater than 500 KOH/g. In some embodiments, the TBN of the overbased magnesium-based detergent is from 500 to 850 KOH/g. In other embodiments, the overbased magnesium-based detergent has a TBN of 600 to 750 KOH/g.

The overbased calcium-based detergent as used in the instant lubricating composition include calcium salts, or mixtures thereof of salixarates and salicylates. In one embodiment, the overbased calcium-based detergent has a metal ratio of at least 5. In one embodiment, the overbased calcium-based detergent is present in the lubricating composition to deliver at least 400 ppm of calcium to the lubricating composition. In one embodiment, the overbased calcium-based detergent is present in the lubricating composition to deliver at least 500 ppm of calcium to the lubricating composition. In another embodiment, the overbased calcium-based detergent is present in the lubricating composition to deliver at least 600 ppm of calcium to the lubricating composition. In another embodiment, the overbased calcium-based detergent is present in the lubricating composition to deliver from 400 to 1200 ppm of calcium to the lubricating composition. In another embodiment, the overbased calcium-based detergent is present in the lubricating composition to deliver from 400 to 700 of calcium to the lubricating composition.

The overbased calcium-based detergent can be present in the lubricating composition in an amount of from 0.1 to 2.5 wt %, or 0.3 to 1.5 wt % or 0.4 to 0.8 wt %, or 0.4 to 0.6 wt %. In some embodiments, the overbased calcium salicylate detergent has a TBN ranging from 300 to 600 KOH/g. In other embodiments, the overbased calcium salicylate detergent has a TBN ranging from 350 to 500 KOH/g.

In one embodiment, the calcium-based detergent is an overbased calcium salicylate detergent. In another embodiment, the calcium-based detergent is an overbased calcium salixarate detergent. In another embodiment, the calcium-based detergent is a mixture of a calcium salicylate detergent and a calcium salixarate detergent.

Molybdenum-Containing Material

In one embodiment, the lubricating composition contains a molybdenum-containing material, which may also be referred to herein as a molybdenum compound. Molybdenum compounds as lubricant additives are known in the art and may serve in various functions, such as antiwear agents, friction modifiers and antioxidants. The use of molybdenum and sulfur containing compositions in lubricating oil compositions as antiwear agents and antioxidants is known. Such materials may be a molybdenum hydrocarbyldithiocarbamate. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition. Other molybdenum-containing materials include molybdenum dihydrocarbyldithio-phosphates. Yet other molybdenum-containing materials include molybdenum-amine compounds as described in U.S. Pat. No. 6,329,327; organomolybdenum compounds made from the reaction of a molybdenum source, fatty oil, and a diamine as described in U.S. Pat. No. 6,914,037; and trinuclear molybdenum-sulfur complexes as described in U.S. Pat. No. 6,232,276. In one embodiment, the molybdenum compound is a molybdenum dithiocarbamate complex, a molybdenum dithiocarbamate dimer complex, or a trinuclear molybdenum compound.

In certain embodiments, the lubricant formulation contains a molbydenum-containing material in an amount to provide 40 to 1200 parts per million by weight molybdenum to the lubricant, or alternatively 50 to 250, 50 to 500, 60 to 200, 300 to 1000, or 400 to 800 parts per million. The actual amount of the molybdenum-containing material will depend in part on the nature and formula weight of the anion or complexing agent associated with the molybdenum, in a way that may be readily calculated. In some embodiments, the molybdenum-containing compound is present in the lubricating composition in an amount of 0 to 1.1 wt %, or 0.01 to 0.5 wt %, or 0.03 to 0.35 wt %, or 0.07 to 0.18 wt %. In some embodiments, the molybdenum-containing compound is present in the lubricating composition in an amount of 0.02 to 0.2 wt %. In other embodiments, the molybdenum-containing compound is present in the lubricating composition in an amount of 0.04 to 0.18 wt %.

Ashless Friction Modifier:

The lubricating composition of the instant disclosure may further include an ashless friction modifier. Friction modifiers that may be useful in an exemplary lubricating composition include fatty acid derivatives such as amines, esters, epoxides, fatty imidazolines, condensation products of carboxylic acids and polyalkylene-polyamines and amine salts of alkylphosphoric acids. Ashless friction modifiers are those which typically do not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

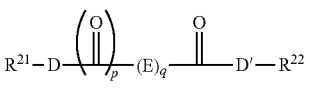

where, D and D' are independently selected from —O—, >NH, >$NR^{23}$, an imide group formed by taking together both D and D' groups and forming a $R^{21}$—N< group between two >C═O groups; E is selected from —$R^{24}$—O—$R^{25}$—, >$CH_2$, >$CHR^{26}$, >$CR^{26}R^{27}$, >C(OH)($CO_2R^{22}$), >C($CO_2R^{22}$)$_2$, and >$CHOR^{28}$; where $R^{24}$ and $R^{25}$ are independently selected from $>CH_2$, $>CHR^{26}$, $>CR^{26}R^{27}$, $>C(OH)(CO_2R^{22})$, and $>CHOR^{28}$; q is 0 to 10, with the proviso that when q=1, E is not $>CH_2$, and when n=2, both Es are not $>CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$)tartrate, di($C_{12-15}$)tartrate, di-oleyltartrate, oleyltartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Useful friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride. In one embodiment, the ashless friction modifier is one or more of an ester, an amide, or an imide of an alpha-hydroxy carbonyl compound, and mixtures thereof.

The ashless friction modifier may be present in the lubricating composition in an amount of from 0.01 to 1.1 wt %, or 0.1 to 0.5 wt %, or 0.2 to 0.4 wt %.

Formulation Additives:

Lubricating compositions as described herein may further contain one or more additives as described below.

Anti-Wear Agent:

Anti-wear agents include phosphorus-containing compounds as well as phosphorus free compounds.

Phosphorus-containing anti-wear agents are well known to one skilled in the art and include metal dialkyl(dithio) phosphate salts, hydrocarbyl phosphites, hydrocarbyl phosphines, hydrocarbyl phosphonates, alkylphosphate esters, amine or ammonium (alkyl)phosphate salts, and combinations thereof.

In one embodiment, the phosphorus-containing anti-wear agent may be a metal dialkyldithiophosphate, which may include a zinc dialkyldithiophosphate. Such zinc salts are often referred to as zinc dialkyldithiophosphates (ZDDP) or simply zinc dithiophosphates (ZDP). They are well known and readily available to those skilled in the art of lubricant formulation. Further zinc dialkyldithiophosphates may be described as primary zinc dialkyldithiophosphates or as secondary zinc dialkyldithiophosphates, depending on the structure of the alcohol used in its preparation. In some embodiments the instant compositions may include primary zinc dialkyldithiophosphates. In some embodiments, the compositions include secondary zinc dialkyldithiophosphates. In some embodiments, the compositions include a mixture of primary and secondary zinc dialkyldithiophosphates. In some embodiments component (b) is a mixture of primary and secondary zinc dialkyldithiophosphates where the ratio of primary zinc dialkyldithiophosphates to secondary zinc dialkyldithiophosphates (one a weight basis) is at least 1:1, or even at least 1:1.2, or even at least 1:1.5 or 1:2, or 1:10.

Examples of suitable metal dialkyldithiophosphate include metal salts of the formula:

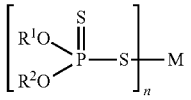

where $R^1$ and $R^2$ are independently hydrocarbyl groups containing 3 to 24 carbon atoms, or 3 to 12 carbon atoms, or 3 to 8 carbon atoms; M is a metal having a valence n and generally incudes zinc, copper, iron, cobalt, antimony, manganese, and combinations thereof. In one embodiment $R^1$ and $R^2$ are secondary aliphatic hydrocarbyl groups containing 3 to 8 carbon atoms, and M is zinc.

ZDDP may be present in the composition in an amount to deliver 0.01 weight percent to 0.12 weight percent phosphorus to the lubricating composition. ZDDP may be present in an amount to deliver at least 100 ppm, or at least 300 ppm, or at least 500 ppm of phosphorus to the composition up to no more than 1200 ppm, or no more than 1000 ppm, or no more than 800 ppm phosphorus to the composition. Further, ZDDP may be present in the lubricating composition in an amount to deliver between 200 ppm un to 1000 ppm, or 450 ppm to 800 ppm, or 600 ppm to 800 ppm phosphorous to the lubricating composition.

In one embodiment, the phosphorus-containing anti-wear agent may be a zinc free phosphorus compound. The zinc-free phosphorus anti-wear agent may contain sulfur or may be sulfur-free. Sulfur-free phosphorus-containing antiwear agents include hydrocarbyl phosphites, hydrocarbyl phosphines, hydrocarbyl phosphonates, alkylphosphate esters, amine or ammonium phosphate salts, or mixtures thereof.

In one embodiment, the anti-wear agent may be a phosphorus-free compound. Examples of suitable phosphorus-free antiwear agents include titanium compounds, hydroxy-carboxylic acid derivatives such as esters, amides, imides or amine or ammonium salt, sulfurized olefins, (thio)carbamate-containing compounds, such as (thio)carbamate esters, (thio)carbamate amides, (thio)carbamic ethers, alkylene-coupled (thio)carbamates, and bis(S-alkyl(dithio)carbamyl) disulfides. Suitable hydroxy-carboxylic acid derivatives include tartaric acid derivatives, malic acid derivatives, citric acid derivatives, glycolic acid derivatives, lactic acid derivatives, and mandelic acid derivatives.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

The anti-wear agent may be represented by the formula:

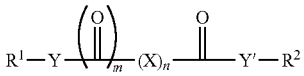

wherein Y and Y' are independently —O—, >NH, >$NR^3$, or an imide group formed by taking together both Y and Y' groups and forming a $R^1$—N< group between two >C=O groups; X is independently —Z—O—Z'—, >$CH_2$, >$CHR^4$, >$CR^4R^5$, >$C(OH)(CO_2R^2)$, >$C(CO_2R^2)_2$, or >$CHOR^6$; Z and Z' are independently >$CH_2$, >$CHR^4$, >$CR^4R^5$, >C(OH)($CO_2R^2$), or >$CHOR^6$; n is 0 to 10, with the proviso that when n=1, X is not >$CH_2$, and when n=2, both X's are not >$CH_2$; m is 0 or 1; $R^1$ is independently hydrogen or a hydrocarbyl group, typically containing 1 to 150 carbon atoms, with the proviso that when $R^1$ is hydrogen, m is 0, and n is more than or equal to 1; $R^2$ is a hydrocarbyl group, typically containing 1 to 150 carbon atoms; $R^3$, $R^4$ and $R^5$ are independently hydrocarbyl groups; and $R^6$ is hydrogen or a hydrocarbyl group, typically containing 1 to 150 carbon atoms.

The phosphorus-free antiwear agent may be present at 0 wt % to 3 wt %, or 0.1 wt % to 1.5 wt %, or 0.5 wt % to 1.1 wt % of the lubricating composition.

The antiwear agent, be it phosphorus-containing, phosphorus free, or mixtures, may be present at 0.15 weight % to 6 weight %, or 0.2 weight % to 3.0 weight %, or 0.5 weight % to 1.5 weight % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

Ashless Antioxidant

The instant compositions may include an ashless antioxidant. Ashless antioxidants may comprise one or more of arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. The antioxidant may be present at least 0.9 wt %, or 0.9 to 2.5 wt %, or 1.1 to 2.0 wt %, or 1.2 weight % to 7 weight %, or 1.2 weight % to 6 weight %, or 1.5 weight % to 5 weight %, of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The diarylamine antioxidant may be present on a weight basis of this lubrication composition at 0.1% to 10%, 0.35% to 5%, or even 0.5% to 2%.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4 propyl-2,6-di-tert-butyl¬phenol or 4-butyl-2,6-di-tert-butylphenol, 4-dodecyl-2,6-di-tert-butyl¬phenol, or butyl 3-(3,5-ditert-butyl-4-hydroxyphenyl)propanoate. In one embodiment, the hindered phenol antioxidant may be an ester and may include, e.g., Irganox™ L-135 from Ciba.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Phenols may include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one embodiment, the phenolic antioxidant comprises a hindered phenol. In another embodiment the hindered phenol is derived from 2,6-ditertbutyl phenol.

In one embodiment the lubricating composition comprises a phenolic antioxidant in a range of 0.01 wt % to 5 wt %, or 0.1 wt % to 4 wt %, or 0.2 wt % to 3 wt %, or 0.5 wt % to 2 wt % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2. Suitable sulfurized olefins include sulfurized alpha olefins containing 10 to 22 carbon atoms, sulfurized isobutylene, sulfurized di-isobutylene, 4-Carbobutoxy cyclohexene, and combinations thereof.

Ashless antioxidants may be used separately or in combination. In one embodiment, two or more different antioxidants are used in combination, such that there is at least 0.1 weight percent of each of the at least two antioxidants and wherein the combined amount of the ashless antioxidants is 1.2 to 7 weight percent. In one embodiment, there may be at least 0.25 to 3 weight percent of each ashless antioxidant.

Additional Metal-Based Detergent:

In addition to the magnesium-based and calcium-based detergents described above, lubricating compositions according to the instant disclosure may further contain additional metal-based detergent(s). The additional metal-based detergent will be a detergent that differs from either the magnesium-based and calcium-based detergents even though they may contain the same metal salt, i.e., a magnesium sulphonate detergent and a magnesium phenate will be considered different detergents. Metal based detergents are generally described above; however, the additional metal-based detergent may be alkali metal or alkaline earth metal salt including sodium salts, calcium salts, magnesium salts, or mixtures thereof of the phenates, sulfur-containing phenates, sulfonates, salixarates and salicylates. The additional metal-based detergent may be either a neutral or overbased detergent. Additional metal-based detergents may be present in the lubricating composition at 0.2 wt % to 15 wt %, or 0.3 wt % to 10 wt %, or 0.3 wt % to 8 wt %, or 0.4 wt % to 3 wt %.

Additional Friction Modifier

The lubricating composition may contain an additional friction modifier(s) different from those described in the foregoing compositions or combinations thereof. Examples of the additional friction modifier(s) include long chain fatty acid derivatives of amines, fatty esters, or epoxides; fatty imidazolines such as condensation products of carboxylic acids and polyalkylene-polyamines; and amine salts of alkylphosphoric acids. The term fatty, as used herein, can mean having a C8-22 linear alkyl group. In one embodiment, the friction modifier may be a glycerol mono-ester, such as glycerol mono-oleate, or a triglyceride, such as sunflower oil, soybean oil, or combinations thereof.

In one embodiment, the additional friction modifier may be a fatty amine, fatty amine alkoxylate, alkoxylated fatty amides or imides, or combinations thereof. Examples of fatty alkoxylates include ethoxylated tallow amine and ethoxylated oleyl amide.

Additional friction modifiers may be present in the lubricating composition from 0.01 wt % up to 2 wt %, or 0.05 wt % up to 1 wt %, or 0.1 wt % up to 0.5 wt %.

Polymeric Viscosity Modifier:

The lubricating composition may contain a polymeric viscosity modifier, a dispersant viscosity modifier different from that of that invention, or combinations thereof. The dispersant viscosity modifier may be generally understood to be a functionalized, i.e. derivatized, form of a polymer similar to that of the polymeric viscosity modifier.

The polymeric viscosity modifier may be an olefin (co) polymer, a poly(meth)acrylate (PMA), a vinyl aromatic-diene copolymer, or mixtures thereof. In one embodiment, the polymeric viscosity modifier is an olefin (co)polymer.

The olefin polymer may be derived from isobutylene or isoprene. In one embodiment, the olefin polymer is prepared from ethylene and a higher olefin within the range of C3-C10 alpha-mono-olefins, for example, the olefin polymer may be prepared from ethylene and propylene.

In one embodiment, the olefin polymer may be a polymer of 15 to 80 mole percent of ethylene, for example, 30 mol percent to 70 mol percent ethylene and from and from 20 to 85 mole percent of C3 to C10 mono-olefins, such as propylene, for example, 30 to 70 mol percent propylene or higher mono-olefins. Terpolymer variations of the olefin copolymer may also be used and may contain up to 15 mol percent of a non-conjugated diene or triene. Non-conjugated dienes or trienes may have 5 to about 14 carbon atoms. The non-conjugated diene or triene monomers may be characterized by the presence of a vinyl group in the structure and can include cyclic and bicycle compounds. Representative dienes include 1,4-hexadiene, 1,4-cyclohexadiene, dicyclopentadiene, 5-ethyldiene-2-norbornene, 5-methylene-2-norbornene, 1,5-heptadiene, and 1,6-octadiene.

In one embodiment, the olefin copolymer may be a copolymer of ethylene, propylene, and butylene. The polymer may be prepared by polymerizing a mixture of monomers comprising ethylene, propylene and butylene. These polymers may be referred to as copolymers or terpolymers. The terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. The butylene may comprise a mixture of butene-1 and isobutylene wherein the weight ratio of butene-1 to isobutylene is about 1:0.1 or less. The butylene may comprise butene-1 and be free of or essentially free of isobutylene.

In one embodiment, the olefin copolymer may be a copolymer of ethylene and butylene. The polymer may be prepared by polymerizing a mixture of monomers comprising ethylene and butylene wherein, the monomer composition is free of or substantially free of propylene monomers (i.e. contains less than 1 weight percent of intentionally added monomer). The copolymer may comprise 30 to 50 mol percent structural units derived from butylene; and from about 50 mol percent to 70 mol percent structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

Useful olefin polymers, in particular, ethylene-α-olefin copolymers have a number average molecular weight ranging from 4500 to 500,000, for example, 5000 to 100,000, or 7500 to 60,000, or 8000 to 45,000.

The formation of functionalized ethylene-α-olefin copolymer is well known in the art, for instance those described in U.S. Pat. No. 7,790,661 column 2, line 48 to column 10, line 38. Additional detailed descriptions of similar functionalized ethylene-α-olefin copolymers are found in International Publication WO2006/015130 or U.S. Pat. Nos. 4,863,623; 6,107,257; 6,107,258; 6,117,825; and 7,790,661. In one embodiment the functionalized ethylene-α-olefin copolymer may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the lubricating composition comprises a dispersant viscosity modifier (DVM). The DVM may comprise an olefin polymer that has been modified by the addition of a polar moiety.

The olefin polymers are functionalized by modifying the polymer by the addition of a polar moiety. In one useful embodiment, the functionalized copolymer is the reaction product of an olefin polymer grafted with an acylating agent.

In one embodiment, the acylating agent may be an ethylenically unsaturated acylating agent. Useful acylating agents are typically α,β unsaturated compounds having at least one ethylenic bond (prior to reaction) and at least one, for example two, carboxylic acid (or its anhydride) groups or a polar group which is convertible into said carboxyl groups by oxidation or hydrolysis. The acylating agent grafts onto the olefin polymer to give two carboxylic acid functionalities. Examples of useful acylating agents include maleic anhydride, chlormaleic anhydride, itaconic anhydride, or the reactive equivalents thereof, for example, the corresponding dicarboxylic acids, such as maleic acid, fumaric acid, cinnamic acid, (meth)acrylic acid, the esters of these compounds and the acid chlorides of these compounds.

In one embodiment, the functionalized ethylene-α-olefin copolymer comprises an olefin copolymer grafted with the acyl group which is further functionalized with a hydrocarbyl amine, a hydrocarbyl alcohol group, amino- or hydroxy-terminated polyether compounds, and mixtures thereof.

Amine functional groups may be added to the olefin polymer by reacting the olefin copolymer (typically, an ethylene-α-olefin copolymer, such as an ethylene-propylene copolymer) with an acylating agent (typically maleic anhydride) and a hydrocarbyl amine having a primary or secondary amino group. In one embodiment, the hydrocarbyl amine may be selected from aromatic amines, aliphatic amines, and mixtures thereof.

In one embodiment, the hydrocarbyl amine component may comprise at least one aromatic amine containing at least one amino group capable of condensing with said acyl group to provide a pendant group and at least one additional group comprising at least one nitrogen, oxygen, or sulfur atom, wherein said aromatic amine is selected from the group consisting of (i) a nitro-substituted aniline, (ii) an amine comprising two aromatic moieties linked by a C(O)NR— group, a —C(O)O— group, an —O— group, an N═N— group, or an —SO2- group where R is hydrogen or hydrocarbyl, one of said aromatic moieties bearing said condensable amino group, (iii) an aminoquinoline, (iv) an aminobenzimidazole, (v) an N,N-dialkylphenylenediamine, (vi), an aminodiphenylamine (also N-phenyl-phenylenediamine), and (vii) a ring-substituted benzylamine.

In another one embodiment, the polar moiety added to the functionalized ethylene-α-olefin copolymer may be derived from a hydrocarbyl alcohol group, containing at least one hydroxy group capable of condensing with said acyl group to provide a pendant group and at least one additional group comprising at least one nitrogen, oxygen, or sulfur atom. The alcohol functional groups may be added to the olefin polymer by reacting the olefin copolymer with an acylating agent (typically maleic anhydride) and a hydrocarbyl alcohol. The hydrocarbyl alcohol may be a polyol compound. Suitable hydrocarbyl polyols include ethylene glycol and propylene glycol, trimethylol propane (TMP), pentaerythritol, and mixtures thereof.

In another one embodiment, the polar moiety added to the functionalized ethylene-α-olefin copolymer may be amine-terminated polyether compounds, hydroxy-terminated polyether compounds, and mixtures thereof. The hydroxy terminated or amine terminated polyether may be selected from the group comprising polyethylene glycols, polypropylene glycols, mixtures of one or more amine terminated polyether compounds containing units derived from ethylene oxides, propylene oxides, butylene oxides or some combination thereof, or some combination thereof. Suitable polyether compounds include Synalox® line of polyalkylene glycol compounds, the UCON™ OSP line of polyether compounds available from Dow Chemical, Jeffamine® line of polyether amines available from Huntsman.

In one embodiment, lubricating composition may comprise a poly(meth)acrylate polymeric viscosity modifier. As used herein, the term "(meth)acrylate" and its cognates means either methacrylate or acrylate, as will be readily understood.

In one embodiment, the poly(meth)acrylate polymer is prepared from a monomer mixture comprising (meth)acrylate monomers having alkyl groups of varying length. The (meth)acrylate monomers may contain alkyl groups that are straight chain or branched chain groups. The alkyl groups may contain 1 to 24 carbon atoms, for example 1 to 20 carbon atoms.

The poly(meth)acrylate polymers described herein are formed from monomers derived from saturated alcohols, such as methyl (meth)acrylate, ethyl (meth)acrylate, propyl (meth)acrylate, butyl (meth)acrylate, 2-methylpentyl (meth) acrylate, 2-propylheptyl (meth)acrylate, 2-butyloctyl (meth) acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl-(meth)acrylate, octadecyl (meth)acrylate, nonadecyl (meth)acrylate, eicosyl (meth)acrylate, (meth)acrylates derived from unsaturated alcohols, such as oleyl (meth)acrylate; and cycloalkyl (meth)acrylates, such as 3-vinyl-2-butylcyclohexyl (meth) acrylate or bornyl (meth)acrylate.

Other examples of monomers include alkyl (meth)acrylates with long-chain alcohol-derived groups which may be obtained, for example, by reaction of a (meth)acrylic acid (by direct esterification) or methyl (meth)acrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment, the poly(meth)acrylate polymer comprises a dispersant monomer; dispersant monomers include those monomers which may copolymerize with (meth)acrylate monomers and contain one or more heteroatoms in addition to the carbonyl group of the (meth)acrylate. The dispersant monomer may contain a nitrogen-containing group, an oxygen-containing group, or mixtures thereof.

The oxygen-containing compound may include hydroxyalkyl(meth)acrylates such as 3-hydroxypropyl(meth)acrylate, 4-dihydroxybutyl(meth)acrylate, 2-hydroxyethyl(meth) acrylate, 2-hydroxypropyl(meth)acrylate, 2,5-dimethyl-1,6-hexanediol (meth)acrylate, 1,10-decanediol(meth)acrylate, carbonyl-containing (meth)acrylates such as 2-carboxyethyl (meth)acrylate, carboxymethyl(meth)acrylate, oxazolidinylethyl(meth)acrylate, N-(methacryloyloxy)formamide, acetonyl(meth)acrylate, N-methacryloylmorpholine, N-methacryloyl-2-pyrrolidinone, N-(2-methacryloyl-oxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxy-heptadecyl)-2-pyrrolidinone; glycol di(meth)acrylates such as 1,4-butanediol(meth)acrylate, 2-butoxyethyl(meth)acrylate, 2-ethoxyethoxymethyl(meth)acrylate, 2-ethoxyethyl(meth) acrylate, or mixtures thereof.

The nitrogen-containing compound may be a (meth) acrylamide or a nitrogen containing (meth)acrylate monomer. Examples of a suitable nitrogen-containing compound include N,N-dimethylacrylamide, N-vinyl carbonamides such as N-vinyl-formamide, vinyl pyridine, N-vinylacetoamide, N-vinyl propionamides, N-vinyl hydroxy-acetoamide, N-vinyl imidazole, N-vinyl pyrrolidinone, N-vinyl caprolactam, dimethylaminoethyl acrylate (DMAEA), dimethylaminoethyl methacrylate (DMAEMA), dimethylaminobutyl acrylamide, dimethylaminopropyl methacrylate (DMAPMA), dimethylaminopropyl acrylamide, dimethylaminopropyl methacrylamide, dimethylaminoethyl acrylamide or mixtures thereof.

Dispersant monomers may be present in an amount up to 5 mol percent of the monomer composition of the (meth) acrylate polymer. In one embodiment, the poly(meth)acrylate is present in an amount 0 to 5 mol percent, 0.5 to 4 mol percent, or 0.8 to 3 mol percent of the polymer composition. In one embodiment, the poly(meth)acrylate is free of or substantially free of dispersant monomers.

In one embodiment, the poly(meth)acrylate comprises a block copolymer or tapered block copolymer. Block copolymers are formed from a monomer mixture comprising one or more (meth)acrylate monomers, wherein, for example, a first (meth)acrylate monomer forms a discrete block of the polymer joined to a second discrete block of the polymer formed from a second (meth)acrylate monomer. While block copolymers have substantially discrete blocks formed from the monomers in the monomer mixture, a tapered block copolymer may be composed of, at one end, a relatively pure first monomer and, at the other end, a relatively pure second monomer. The middle of the tapered block copolymer is more of a gradient composition of the two monomers.

In one embodiment, the poly(meth)acrylate polymer (P) is a block or tapered block copolymer that comprises at least one polymer block ($B_1$) that is insoluble or substantially insoluble in the base oil and a second polymer block ($B_2$) that is soluble or substantially soluble in the base oil.

In one embodiment, the poly(meth)acrylate polymers may have an architecture selected from linear, branched, hyperbranched, cross-linked, star (also referred to as "radial"), or combinations thereof. Star or radial refers to multi-armed polymers. Such polymers include (meth)acrylate-containing polymers comprising 3 or more arms or branches, which, in some embodiments, contain at least about 20, or at least 50 or 100 or 200 or 350 or 500 or 1000 carbon atoms. The arms are generally attached to a multivalent organic moiety which acts as a "core" or "coupling agent." The multi-armed polymer may be referred to as a radial or star polymer, or even a "comb" polymer, or a polymer otherwise having multiple arms or branches as described herein.

Linear poly(meth)acrylates, random, block or otherwise, may have weight average molecular weight ($M_w$) of 1000 to 400,000 Daltons, 1000 to 150,000 Daltons, or 15,000 to 100,000 Daltons. In one embodiment, the poly(meth)acrylate may be a linear block copolymer with a Mw of 5,000 to 40,000 Daltons, or 10,000 to 30,000 Daltons.

Radial, cross-linked or star copolymers may be derived from linear random or di-block copolymers with molecular weights as described above. A star polymer may have a weight average molecular weight of 10,000 to 1,500,000 Daltons, or 40,000 to 1,000,000 Daltons, or 300,000 to 850,000 Daltons.

In one embodiment, the lubricating composition may comprise a vinylaromatic-diene copolymer. The vinylaromatic-diene copolymer may be a linear or radial block copolymer. In one embodiment the vinylaromatic-diene copolymer may be a hydrogenated styrene-(conjugated diene) block copolymer.

The block copolymer in different embodiments may be a hydrogenated styrene-butadiene copolymer or a hydrogenated styrene-isoprene copolymer. Both block copolymers are known in the art and are disclosed for example in EP 2 001 983 A (Price et al.) for hydrogenated styrene-butadiene and U.S. Pat. No. 5,490,945 (Smith et al.) for hydrogenated styrene-isoprene.

The butadiene block of the hydrogenated styrene-butadiene copolymer may be prepared with by either 1,2-addition or 1,4-addition, with 1,2-addition preferred as is disclosed in EP 2 001 983 A. Using 1,2-addition results in a butadiene block having 20 mol % to 80 mol %, or 25 mol % to 75 mol %, or 30 mol % to 70 mol %, or 40 mol % to 65 mol % of repeat units of branched alkyl groups due to initially-formed pendant unsaturated or vinyl groups, upon hydrogenation, become alkyl branches.

The lubricating compositions may comprise 0.05 weight % to 2 weight %, or 0.08 weight % to 1.8 weight %, or 0.1 to 1.2 weight % of the one or more polymeric viscosity modifiers and/or dispersant viscosity modifiers as described herein.

Other Performance Additives:

Various embodiments of the compositions disclosed herein may optionally comprise one or more additional performance additives. These additional performance additives may include one or more metal deactivators, corrosion inhibitors, extreme pressure agents, foam inhibitors, demulsifiers, pour point depressants, seal swelling agents, and any combination or mixture thereof. Typically, fully-formulated lubricating oil will contain one or more of these performance additives, and often a package of multiple performance additives. However, such performance additives are included based on the application of the lubricating composition, and the specific performance additive and treat rate thereof would be apparent to one of ordinary skill in the art in view of this disclosure.

In one embodiment, a lubricating composition may further comprise a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, or 5 ppm to 300 ppm, or 20 ppm to 250 ppm of molybdenum Other performance additives such as corrosion inhibitors include those described in paragraphs 5 to 8 of U.S. application Ser. No. 05/038,319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides.

Pour point depressants that may be useful in the lubricating compositions disclosed herein further include polyalphaolefins, esters of maleic anhydride-styrene, poly(meth) acrylates, polyacrylates or polyacrylamides.

In different embodiments, the lubricating composition may have a composition as described in the following table:

| | Embodiments (weight %) | | | |
|---|---|---|---|---|
| Additive | A | B | C | D |
| Boron-free PIB succinimide dispersant ($M_N$ 750-1750) | 0.5 to 5 | 0.9 to 4.1 | 1.5 to 3.2 | 1.9 to 2.4 |
| Boron-free PIB succinimide dispersant ($M_N$ 1950-2500) | 0.1 to 4 | 0.2 to 2 | 0.4 to 1.4 | 0.5 to 0.8 |
| Boron-containing PIB succinimide dispersant ($M_n$ 1750-2200) | 0.2 to 2.1 | 0.5 to 1.8 | 1 to 2.1 | 1.5 to 1.7 |
| Overbased calcium-based detergent | 0 to 2 | 0 to 1,4 | 0.1 to 1.2 | 0 to 0.9 |
| Overbased Magnesium-based detergent | 0.1 to 2.8 | 0.15 to 1.6 | 0.2 to 0.9 | 0.25 to 0.65 |
| Ashless friction modifier | 0 to 2.0 | 0.01 to 1.6 | 0.1 to 1.2 | 0.4 to 0.8 |
| Molybdenum additive | 0 to 1.1 | 0.01 to 0.5 | 0.03 to 0.35 | 0.07 to 0.18 |
| Ashless Antioxidants | 0 to 5 | 0.5 to 4.2 | 0.8 to 2.7 | 1.2 to 2.2 |
| Antiwear agent | 0 to 5 | 0.1 to 2.3 | 0.3 to 1.3 | 0.4 to 1.0 |
| Any Other Performance Additive | 0 to 2.5 | 0.01 to 1.7 | 0.15 to 1.2 | 0.2 to 0.85 |
| Oil of Lubricating Viscosity | Balance to 100% | | | |

In one embodiment the lubricating composition may have (i) a sulfur content of 0.3 wt % or less, (ii) a phosphorus content of 0.15 wt % or less, and (iii) a sulfated ash content of 0.5 wt % to 1.5 wt % or less. In one embodiment the lubricating composition may have (i) a sulfur content of 0.3 wt % or less, (ii) a phosphorus content of 0.09 wt % or less, and (iii) a sulfated ash content of 0.5 wt % to 0.9 wt % or less. In another embodiment, the lubricating composition may have at least one of (i) a sulfur content of 0.2 wt % to 0.4 wt % or less, (ii) a phosphorus content of 0.05 wt % to 0.15 wt %, and (iii) a sulfated ash content of 0.5 wt % to 1.5 wt % or less.

The lubricating compositions disclosed herein can have a kinematic viscosity at 100° C. of from 5 to 12 cSt ($mm^2/s$) and a kinematic viscosity at 40° C. of from 40 to 50 cSt ($mm^2/s$). In another embodiment, the lubricating composition has a kinematic viscosity at 100° C. of from 6 to 10 cSt ($mm^2/s$) and a kinematic viscosity at 40° C. of from 40 to 47 cSt ($mm^2/s$).

The lubricating composition including the dispersant additive package has a high temperature, high shear viscosity (HTHS) of less than 5 mPa-s measured at 150° C. per ASTM D4683. In one embodiment, the HTHS viscosity is less than 4 mPa-s. In another embodiment, the HTHS of the lubricating composition is 3.0 to 4.5 mPa-s.

The lubricating composition including the dispersant additive package has a TBN of from 4 to 14 mg KOH/g. In another embodiment, the lubricating TBN is from 5 to 10 or 6 to 8 mg KOH/g.

The instant disclosure further provides for methods of lubricating a gasoline-fueled internal combustion engine by supplying the engine a lubricating composition as disclosed herein. Generally, the lubricant is added to the lubricating system of the internal combustion engine, which then delivers the lubricating composition to the critical parts of the engine, during its operation, that require lubrication.

The lubricating compositions described above may be utilized in an internal combustion engine having a surface of steel or aluminum (typically a surface of steel) and may also be coated for example with a diamondlike carbon (DLC) coating.

The internal combustion engine may be fitted with an emission control system or a turbocharger. Examples of the emission control system include diesel particulate filters (DPF), gasoline particulate filters (GPF), systems employing selective catalytic reduction (SCR), and combinations thereof.

The internal combustion engines may be port fuel injected (PFI) or direct injected. In one embodiment, the internal combustion engine is a gasoline direct injection engine (GDI). Direct injection engines are characterized by injection of the fuel, e.g., gasoline, directly into the cylinder. This is distinct from port fuel injection (PFI) and can result in higher efficiency, higher compression, and/or higher brake mean effective pressure than analogous PFI engines.

In one embodiment, the internal combustion engine is equipped with a turbocharger, a supercharger, or combinations thereof. Turbochargers and superchargers both work to increase the volumetric efficiency of engines, i.e. the volume of air that fills a cylinder relative to the volume of the cylinder. Turbochargers and superchargers work by forcing more air into the cylinder, resulting in higher torque for a given displacement, and hence higher BMEP. In addition to improving the efficiency of an engine, turbochargers and superchargers can increase the likelihood of stochastic pre-ignition, especially at lower speeds.

The lubricating compositions as disclosed herein may be used to lubricate an internal combustion engine operating with a brake mean effective pressure (BMEP) of greater than 12 bars and at a speed of less than 3,000 rpm by supplying to said engine the lubricating composition. In some embodiments, the internal combustion engine is a turbo-charged direct-injection (TDi) engine.

The method embodiments of the instant disclosure may include supplying to an internal combustion engine a lubricating composition including an oil of lubricating viscosity comprising at least 50 wt % of a Group III base oil; at least one boron-containing polyisobutenyl succinimide dispersant; a boron-free polyisobutenyl succinimide dispersant; an overbased magnesium-based detergent in an amount to deliver at least 400 ppm of magnesium to the lubricating composition; an overbased calcium-based detergent in an amount to deliver at least 400 ppm calcium to the lubricating composition; an ashless friction modifier; and, optionally, other additives.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character including one or more double bonds. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); [0081] substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1-5 wt. % refers to groups having 1, 2, 3, 4, or 5 wt. %, and so forth, including all points therebetween.

As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

Unless otherwise stated, "wt %" as used herein shall refer to the weight percent based on the total weight of the composition.

The instant disclosure is suitable for lubricant formulations exhibiting one or more of improved cleanliness ratings, improved fuel economy, reduced low speed preignition ("LSPI") and improved TBN retention over lubricant formulations not including the additives of the instant lubricating formulations. It is contemplated that cleanliness ratings, improved fuel economy, reduced low speed preignition ("LSPI") and improved TBN retention can be measured and compared under industry standard test, which are apparent to one of ordinary skill in the art in view of this disclosure. The forgoing may be better understood with reference to the following examples:

Examples

Embodiments will be further illustrated by the following examples, which set forth particularly advantageous embodiments. While the examples are provided to illustrate certain embodiments, they are not intended to be limiting.

Lubricating Compositions

A series of engine additive formulations are prepared containing the dispersant and detergent additives described above as well as conventional additives including friction modifiers, anti-wear agents, polymeric viscosity modifier, antioxidants (combination of phenolic ester and diarylamine), as well as other performance additives as follows (Table 1). The phosphorus, sulfur and ash contents of each of the examples are also presented in the table in part to show that each example has a similar amount of these materials and so provide a proper comparison between the comparative and examples according to embodiments described herein.

TABLE 1

| Additive Formulations[1] | | | | | | | | |
|---|---|---|---|---|---|---|---|---|
| | ADD1 | ADD2 | ADD3 | ADD4 | ADD5 | ADD6 | ADD7 | ADD8 |
| Boron-free PIB succinimide dispersant (MN 750-1750) | 3.55 | 2.13 | 2.13 | 2.13 | 2.13 | 2.13 | 2.13 | 2.13 |
| Boron-free PIB succinimide dispersant (MN 1950-2500) | 0.52 | 0.65 | 0.65 | 0.65 | 0.65 | 0.65 | 0.65 | 0.65 |
| Boron-containing PIB succinimide dispersant (Mn 1750-2200) | 0 | 1.6 | 1.6 | 1.6 | 1.6 | 1.6 | 1.6 | 1.6 |
| Calcium Salicylate Detergent[2] | 0 | 0.5 | 0.5 | 0.5 | 0.5 | 0.5 | 0.5 | 0.5 |
| Magnesium Sulfonate Detergent[3] | 0 | 0.3 | 0.3 | 0.3 | 0.3 | 0.3 | 0.3 | 0.3 |
| Calcium Sulfonate Detergent[4] | 0.23 | 0 | 0 | 0 | 0 | 0 | 0 | 0 |
| Calcium Sulfur-coupled Phenate | 0.74 | 0 | 0 | 0 | 0 | 0 | 0 | 0 |
| Calcium Salixarate | 0.25 | 0.33 | 0.33 | 0.33 | 0.33 | 0.33 | 0.33 | 0.33 |
| Molybdenum dithiocarbamate (contains 20% wt Mo) | 0 | 0 | 0.15 | 0 | 0.08 | 0.05 | 0.025 | 0.15 |
| Borated Friction Modifier[5] | 0 | 0.64 | 0.64 | 0.64 | 0.64 | 0.64 | 0.64 | 0.64 |
| Ashless Antioxidants[7] | 1.9 | 2.0 | 1.7 | 2.0 | 2.0 | 2.0 | 2.0 | 2.0 |
| C3/C6 Secondary ZDDP | 0.27 | 0.18 | 0.18 | 0.14 | 0.14 | 0.14 | 0.14 | 0.14 |
| C6 Secondary ZDDP | 0.5 | 0.6 | 0.6 | 0.7 | 0.7 | 0.7 | 0.7 | 0.7 |

TABLE 1-continued

| Additive Formulations[1] | | | | | | | | |
|---|---|---|---|---|---|---|---|---|
| | ADD1 | ADD2 | ADD3 | ADD4 | ADD5 | ADD6 | ADD7 | ADD8 |
| Additional Additives[8] | 0.35 | 0.05 | 0.05 | 0.05 | 0.05 | 0.05 | 0.05 | 0.05 |
| Molybdenum (theory) (ppm) | 0 | 0 | 300 | 0 | 160 | 100 | 50 | 300 |

[1]All amounts shown above are in weight percent and are on an oil-free basis unless otherwise noted.
[2]Overbased calcium salicylate (TBN = 485 mg KOH/g; metal ratio 5.5)
[3]Overbased magnesium alkylbenzene sulfonate (TBN 690 mg KOH/g: metal ratio 14)
[4]Overbased calcium alkylbenzene sulfonate (TBN 690 mg KOH/g; metal ratio 14)
[5]Combination of oleyl tartrimide, trialkyl borate ester, and succinimide dispersant (0.46% boron)
6—Combination of glycerol mono-oleate and triglyceride
[7]Combination of hindered phenol ester, alkylated diphenylamine, and sulfurized olefin
[8]The Additional Additives used in the examples include anti-foam agents, emulsifier, corrosion inhibitor, and includes some amount of diluent oil A series of lubricating compositions were prepared in Group III and/or polyalphaolefin (Group IV) base oils by combining the Additives of Table 1 with styrene butadiene viscosity modifier as summarized in Tables 2 and 3.

TABLE 2

| Lubricating Compositions | | | | | | |
|---|---|---|---|---|---|---|
| | EX1 5W-30 | EX2 5W-40 | EX3 5W-40 | EX4 5W-30 | EX5 5W-30 | EX6 5W-30 |
| 5 cSt Group III Base Oil | 59.5 | | | | | |
| 4.3 cSt Group III Base Oil | 10.1 | 28.5 | 31.8 | 41.5 | 33.6 | 29.6 |
| 6 cSt Group III Base Oil | | 42 | 40 | 31.3 | 36.8 | 44 |
| PAO-6 Base Oil | | | | | 3 | |
| ADD1 | 8.3 | | | | | |
| ADD2 | | 9.0 | 9.0 | 9.0 | 9.0 | |
| ADD3 | | | | | | 9.15 |
| AO booster[2] | 1.9 | 0 | 0 | 0 | 0 | 0 |
| Friction Modifier[3] | 0.5 | 0 | 0 | 0 | 0 | 0 |
| Styrene Butadiene block copolymer | 1.3 | 1.3 | 1.2 | 1.2 | 1.1 | 1.1 |
| Pourpoint Depressant | 0.2 | 0.2 | 0.2 | 0.2 | 0.2 | 0.2 |
| Kinematic viscosity at 100° C. (cSt) | 12.01 | 13.1 | 12.4 | 11.9 | 11.9 | 11.9 |
| HTHS viscosity (D4741) (cP) | 3.6 | 3.7 | 3.6 | 3.5 | 3.4 | 3.5 |
| Phosphorus (ppm) | 780 | 800 | 770 | 780 | 760 | 760 |
| Zinc (ppm) | 860 | 860 | 870 | 830 | 890 | 860 |
| Calcium (ppm) | 1930 | 1050 | 1070 | 1060 | 1120 | 1060 |
| Magnesium (ppm) | 20 | 480 | 460 | 490 | 470 | 480 |
| Boron (ppm) | 0 | 170 | 170 | 170 | 160 | 160 |
| Molybdenum (ppm) | 0 | 0 | 0 | 0 | 0 | 290 |

1—All amounts shown above are in weight percent and are on an oil-free basis unless otherwise noted
[2]LZ 8603B
[3]Combination of glycerol mono-oleate and triglyceride

TABLE 3

| Lubricating Compositions | | | | | |
|---|---|---|---|---|---|
| | EX7 5W-30 | EX8 5W-40 | EX9 5W-40 | EX10 5W-30 | EX11 5W-30 |
| 4.3 cSt Group III Base Oil | 29.7 | 29.75 | 29.8 | 29.55 | 33.6 |
| 6 cSt Group III Base Oil | 29.7 | 29.75 | 29.8 | 29.55 | 36.8 |
| PAO-6 Base Oil | 0 | | | | 3.0 |
| ADD4 | | | | | 9.04 |
| ADD5 | 9.12 | | | | |
| ADD6 | | 9.09 | | | |
| ADD7 | | | 9.07 | | |
| ADD8 | | | | 9.19 | |
| Styrene Butadiene block copolymer | 1.1 | 1.1 | 1.1 | 1.1 | 1.1 |
| Pourpoint Depressant | 0.2 | 0.2 | 0.2 | 0.2 | 0.2 |
| Kinematic viscosity at 100° C. (cSt) | 11.74 | 11.77 | 11.79 | 11.85 | 11.88 |
| HTHS viscosity (D4741) (cP) | 3.47 | 3.48 | 3.48 | 3.45 | 3.47 |
| Phosphorus (ppm) (calc) | 796 | 796 | 796 | 796 | 760 |
| Zinc (ppm) (calc) | 869 | 869 | 869 | 869 | 831 |
| Calcium (ppm) (calc) | 1084 | 1084 | 1084 | 1084 | 1084 |
| Magnesium (ppm) (calc) | 475 | 475 | 475 | 475 | 475 |

TABLE 3-continued

| Lubricating Compositions | EX7 5W-30 | EX8 5W-40 | EX9 5W-40 | EX10 5W-30 | EX11 5W-30 |
|---|---|---|---|---|---|
| Boron (ppm) | 171 | 171 | 171 | 171 | 174 |
| Molybdenum (ppm) | 160 | 100 | 50 | 300 | 0 |

Testing

Lubricating compositions are evaluated for their ability to prevent wear, improve engine cleanliness (deposits), and improve fuel economy. The BMW N20 Endurance Engine Oil Test. The N20 test is a 395 hour test that is used to evaluate the lubricating composition for piston cleanliness, engine sludge, turbocharger deposits, and wear iron. Lubricating compositions are evaluated for fuel economy performance in the New European Drive Cycle (NEDC) in two Mercedes Benz vehicles, OM 271FE and OM642FE. The results are summarized in Table 4 below.

TABLE 4

| Deposit and Fuel Economy Performance Testing | EX1 5W-30 | EX2 5W-40 | EX3 5W-40 | EX4 5W-30 |
|---|---|---|---|---|
| BMW N20 ENDURANCE | | | | |
| Sludge Rating (average) (Merit) | 9.0 | 9.4 | 9.4 | |
| Piston Cleanliness (average) (Merit) | 40.7 | 44.3 | 44.1 | |
| Piston Cleanliness (Delta from Pass Limit) (Merit) | −6.3 | 0.3 | 0.1 | |
| Piston Ring sticking | NO | NO | NO | |
| Turbocharger Deposits (Demerit) | 2.1 | 2.0 | 2.0 | |
| Iron Content at End of Test | 95 | 66 | 74 | |
| Change in Kinematic Viscosity at 40° C. | −12.5 | −10.7 | −9 | |
| Change in Kinematic Viscosity at 100° C. | −0.5 | −4.7 | −7.7 | |
| NEDC Fuel Economy Test | | | | |
| OM271FE 01 NEDC C200K | | | | |
| FUEL CONSUMPTION REF [l/100 km@23° C.] | 9.07 | | | 8.96 |
| FUEL CONSUMPTION CAN [l/100 km@23° C.] | 9.03 | | | 8.88 |
| DIFFERENCE [l/100 km@23° C.] | 0.04 | | | 0.08 |
| FUEL ECONOMY % | 0.4 | | | 0.91 |
| OM642FE 01 NEDC C320 CDI | | | | |
| FUEL CONSUMPTION REF [l/100 km@23° C.] | 8.42 | | | 8.33 |
| FUEL CONSUMPTION CAN [l/100 km@23° C.] | 8.35 | | | 8.18 |
| DIFFERENCE [l/100 km@23° C.] | 0.07 | | | 0.15 |
| FUEL ECONOMY % | 0.83 | | | 1.81 |

Lubricating compositions are also evaluated in the PV1800 Volkswagen biodiesel sludge engine test, a test which measures the ability of a lubricating oil composition to prevent damage due to oil sludge formation in the presence of biodiesel fuel.

TABLE 5

| Biodiesel Sludge Testing (VW PV1800) | EX5 | EX6 | EX7 | EX8 | EX9 | EX10 | EX11 |
|---|---|---|---|---|---|---|---|
| Sludge Rating (merit; 10.0 max) | 1.79 | 9.3 | 7.8 | 7.8 | 2.3 | 9.3 | 1.6 |
| Piston Cleanliness (merit; higher is better) | 12.9 | 31.8 | 23.7 | 17.0 | 17.9 | 28.9 | 13.6 |
| Piston Ring Sticking (rating; lower is better) | 10.0 | 0.0 | 0.0 | 2.0 | 5.0 | 0.0 | 17.0 |

TABLE 5-continued

| Biodiesel Sludge Testing (VW PV1800) | EX5 | EX6 | EX7 | EX8 | EX9 | EX10 | EX11 |
|---|---|---|---|---|---|---|---|
| Hours Completed (completed test is 96 hr) | 33 | 96 | 96 | 96 | 40 | 96 | 27 |

The results indicate that addition of molybdenum to the formulation results in improved sludge handling and cleanliness when the engine is fueled with a biodiesel-containing fuel composition. A minimum level of molybdenum allows the test to be run to completion.

What is claimed is:

1. An internal combustion engine lubricating composition comprising:

oil of lubricating viscosity comprising at least 50 weight percent of a Group III base oil, a Group IV base oil, or combinations thereof;

a boron-containing polyisobutenyl succinimide dispersant, wherein the boron-containing succinimide dispersant is derived from a polyisobutylene having a vinylidene content of greater than 70 mol % where the dispersant has a number average molecular weight of from 1750 to 2200 and wherein the boron-containing succinimide dispersant is present in the lubricating composition in an amount of 0.2 to 2.1 wt %;

a boron-free polyisobutenyl succinimide dispersant wherein the boron-free polyisobutenyl succinimide dispersant includes a combination of a first boron-free polyisobutenyl succinimide dispersant having a number average molecular weight of from 1150 to 1650 and a second boron-free polyisobutenyl succinimide dispersant having a number average molecular weight of from 1950 to 2500, wherein the first boron-free polyisobutylene succinimide dispersant is present in an amount of 60% to 90% by weight of the total combination of the first boron-free polyisobutenyl succinimide dispersant and the second boron-free polyisobutenyl succinimide dispersant and wherein the boron-free polyisobutenyl succinimide dispersant is present in the lubricating composition in an amount of 0.5 to 6.5 wt. %;

an overbased magnesium-based detergent in an amount to deliver at least 400 ppm magnesium to the lubricating composition;

an overbased calcium-based detergent in an amount to deliver at least 400 ppm calcium to the lubricating composition; and a molybdenum-containing material.

2. The lubricating composition according to claim 1, wherein the boron-free polyisobutenyl succinimide dispersant includes a first boron-free polyisobutenyl succinimide dispersant is present in the lubricating composition in an amount of from 1.8 to 2.5 wt % and a second boron-free polyisobutenyl succinimide dispersant having a number average molecular weight of from 1950 to 2500 and is present in the lubricating composition an amount of from 0.5 to 0.8 wt %.

3. The lubricating composition according to claim 1, wherein the overbased magnesium-based detergent is present in the lubricating composition in an amount of from 0.1 to 1.5 wt %.

4. The lubricating composition according to claim 1, wherein the overbased magnesium-based detergent is an overbased alkylbenzene sulfonate detergent having a metal ratio of at least 8.

5. The lubricating composition according to claim 1, wherein the overbased magnesium-based detergent has a TBN (KOH/g) greater than 500.

6. The lubricating composition according to claim 1, wherein the overbased magnesium-based detergent has a TBN (KOH/g) of from 500 to 850.

7. The lubricating composition according to claim 1, wherein the overbased magnesium-based detergent delivers from 400 to 700 ppm magnesium to the lubricating composition.

8. The lubricating composition according to claim 1, wherein the overbased calcium-based detergent is present in the lubricating composition in an amount of from 0.1 to 2.5 wt %.

9. The lubricating composition according to claim 1, wherein the overbased calcium-based detergent has a metal ratio of at least 5.

10. The lubricating composition according to claim 1, wherein the overbased calcium-based detergent has a TBN (KOH/g) from 450 to 850.

11. The lubricating composition according to claim 1, wherein the overbased calcium-based detergent delivers from 400 to 1200 ppm calcium to the lubricating composition.

12. The lubricating composition according to claim 1, wherein the overbased calcium-based detergent is selected from an overbased calcium salixarate detergent, an overbased calcium salicylate detergent, and mixtures thereof.

13. The lubricating composition according to claim 1, wherein the overbased calcium-based detergent is an overbased calcium salicylate detergent.

14. The lubricating composition according to claim 1, wherein the overbased calcium-based detergent includes a mixture of an overbased calcium salixarate detergent and an overbased calcium salicylate detergent.

15. The lubricating composition according to claim 1, further comprising an ashless antioxidant present in an amount of at least 0.9 weight percent of the lubricating composition.

16. The lubricating composition according to claim 1, further comprising an ashless friction modifier selected from one or more of an ester, an amide, or an imide of an alpha-hydroxy carbonyl compound, and mixtures thereof present in the lubricating composition in an amount of from 0.01 to 1.1 wt %.

17. The lubricating composition according to claim 1, further comprising a zinc dialkyldithiophosphate anti-wear agent in an amount to deliver 200 ppm up to 1000 ppm phosphorus to the lubricating composition.

18. The lubricating composition according to claim 1, wherein the lubricating composition is free of or substantially free of tetrapropenylphenol (pddp) and derivatives thereof.

19. The lubricating composition according to claim 1, wherein the molybdenum-containing material is selected from a molybdenum dithiocarbamate complex, a molybdenum dithiocarbamate dimer complex, and a tri-nuclear molybdenum compound.

20. The lubricating composition according to claim 1, wherein the molybdenum-containing material is present in an amount to provide 40 to 1200 ppm by weight molybdenum to the lubricating composition.

21. The lubricating composition according to claim 1, wherein the molybdenum-containing material is present in an amount to provide 60 to 200 ppm by weight molybdenum to the lubricating composition.

22. A method of operating a gasoline-fueled internal combustion engine comprising supplying to an internal combustion engine a lubricating composition according to claim 1.

23. A method for reducing low speed preignition in a gasoline-fueled internal combustion engine operating at a brake mean effective pressure (BMEP) of greater than 12 bars and at a speed of less than 3,000 RPMs comprising: supplying to said engine a lubricating composition according to claim 1.

24. The method of claim 23 where the gasoline-fueled internal combustion engine further comprises a turbo charger.

* * * * *